United States Patent [19]

Otsubo et al.

[11] 4,027,633

[45] June 7, 1977

[54] IGNITION TIMING CONTROL SYSTEM

[75] Inventors: Kizuku Otsubo, Kokubunji; Toru Suyama, Tokorozawa; Masanori Udagawa, Musashino, all of Japan

[73] Assignee: Nissan Motor Co., Ltd., Yokohama, Japan

[22] Filed: July 11, 1975

[21] Appl. No.: 595,146

[30] Foreign Application Priority Data

July 13, 1974 Japan ..... 49-82778[U]

[52] U.S. Cl. ..... 123/117 A; 123/117 R; 137/468

[51] Int. Cl.[2] ..... F02D 5/04

[58] Field of Search .... 123/117 A, 117 R, 146.5 A; 137/468; 251/11; 60/285

[56] References Cited

UNITED STATES PATENTS

| | | | |
|---|---|---|---|
| 2,942,596 | 6/1960 | Carlson | 123/119 F |
| 3,159,692 | 12/1964 | Kittler | 123/119 F X |
| 3,704,697 | 12/1972 | Weymann | 123/117 A |
| 3,721,222 | 3/1973 | Shioya et al. | 123/117 A X |
| 3,783,846 | 1/1974 | Barnhart et al. | 123/117 A |
| 3,813,877 | 6/1974 | Hunt | 123/117 A X |
| 3,841,551 | 10/1974 | Ota | 123/117 A X |
| 3,987,770 | 10/1976 | Nomura | 123/117 A |

*Primary Examiner*—C. J. Husar
*Assistant Examiner*—Tony M. Argenbright

[57] ABSTRACT

Two bimetallic leaf valves having thermal hysteresis characteristics different from each other are provided to permit or inhibit transmission of engine induction passage vacuum to a distributor motor to advance or retard the ignition timing in accordance with engine temperature of the time of start of the engine and within a predetermined temperature range after starting the engine.

7 Claims, 2 Drawing Figures

IGNITION TIMING CONTROL SYSTEM

The present invention relates generally to an ignition timing control system for an internal combustion engine equipped with an exhaust gas purifying device and particularly to an ignition timing control system for the engine which retards or advances the ignition timing in accordance with the engine temperature at start of the engine to quickly warm up the engine and the exhaust gas purifying device.

As is well known in the art, internal combustion engines are currently equipped with exhaust gas purifying or reburning devices such as a thermal reactor, afterburner or catalytic converter in the exhaust system. When a spark ignition type engine of this type is started with the engine temperature such as, for example, the engine coolant temperature in a predetermined temperature range, for example, 15° C~45° C, it is necessary to retard the ignition timing. This is to promote warming-up of the exhaust gas purifying device to effectively oxidize burnable harmful components such as hydrocarbons and carbon monoxide in exhaust gas discharged from the engine to harmless components such as water and carbon dioxide. When the exhaust gas purifying device is warmed up to the predetermined temperature after starting the engine, it is necessary to advance the ignition timing. This is to improve engine performance and accordingly fuel consumption characteristics. Furthermore, when the engine is started at the engine temperature lower than a temperature in the above-mentioned predetermined range under cold condition such as winter, it is necessary to advance the ignition timing. This is to increase engine output to prevent the cold engine from being difficult to start or from stopping due to great resistance against movement of operating or sliding parts of the engine.

It is, therefore, an object of the invention to provide a new and very useful ignition timing control system which retards or advances the ignition timing in accordance with the engine temperature of the time of start of the engine and within a predetermined temperature range after starting the engine to at any time meet the three requirements mentioned above.

Figure 1:
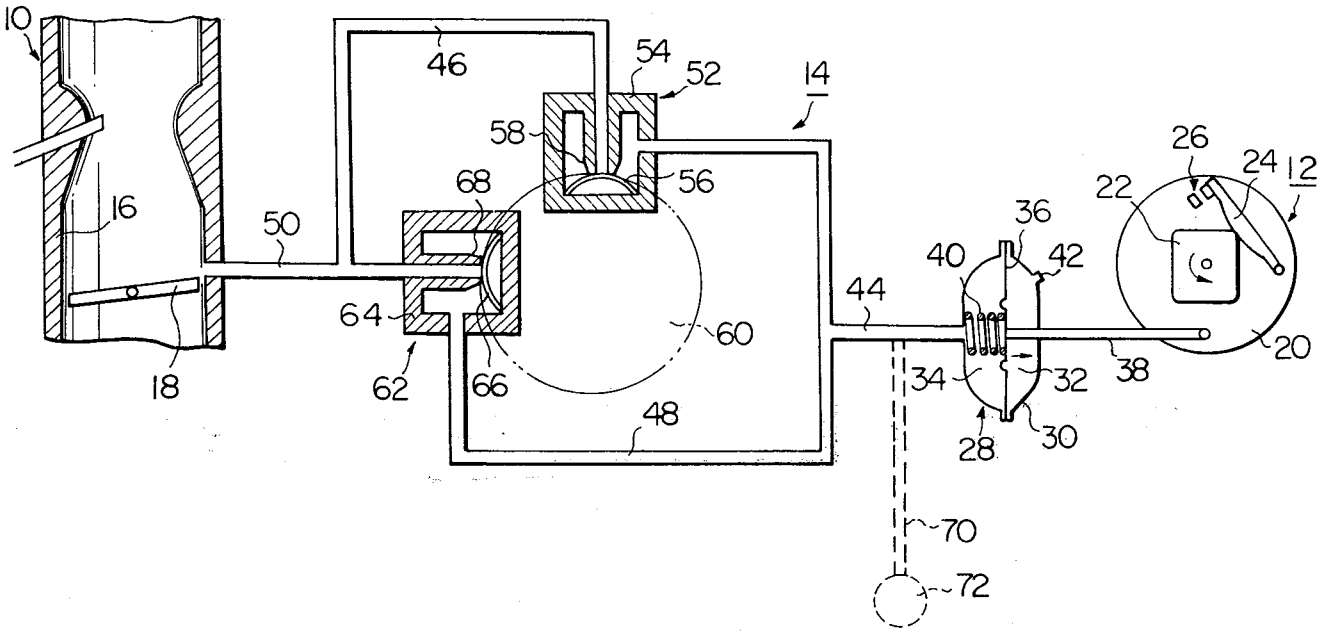
Figure 2:
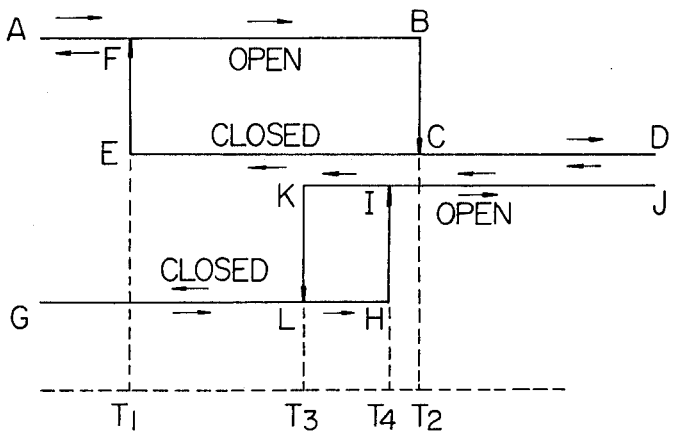

This and other objects and advantages of the invention will become more apparent from the following detailed description taken in conjunction with the accompanying drawings in which:

FIG. 1 is a schematic view of a preferred embodiment of an ignition timing control system according to the invention; and FIG. 2 is a graphic representation of the relationship between engine temperature and closing and opening of two valves consitituting part of the ignition timing control system shown in FIG. 1.

Referring to FIG. 1 of the drawings, there is shown a carburettor 10 for a spark ignition type internal combustion engine 11, an ignition distributor 12 for the engine, and an ignition timing control system according to the invention which is generally designated by the reference numeral 14. The carburettor 10 is shown to include an induction passage or passageway 16 vented from the ambient atmosphere and connected to an intake manifold (not shown) of the engine, and a throttle valve 18 rotatably mounted in the induction passage 16. The ignition distributor 12 includes a breaker plate 20 rotatably mounted on a stationary portion of the ignition distributor and movable with respect to a cam 22. The cam 22 has a number of peaks corresponding to the number of engine cylinders. The cam 22 with its peaks cooperates with a contact arm 24 of a breaker point set 26 to make and break the spark connection in a known manner for each one-fourth (in this case) rotation of the cam 22.

The ignition timing control system 14 comprises a vacuum motor 28 which controls the ignition timing of the engine. The vacuum motor 28 is a conventional diaphragm assembly and has a hollow housing 30 the interior of which is divided into an atmospheric pressure chamber 32 and a vacuum chamber 34 by a pressure sensitive or responsive deformable member such as a flexible diaphragm 36. The diaphragm 36 is fixedly secured to an actuating rod 38 which is pivotably connected to the breaker plate 20. A rightward movement of the actuating rod 38 causes the breaker plate 20 to rotate counterclockwise in the drawing to retard the ignition timing, while a leftward movement of the actuating rod 38 causes the breaker plate 20 to rotate clockwise in the drawing to advance the ignition timing. The diaphragm 36 and actuating rod 38 are biased in a rightward retard direction by a compression spring 40. The chamber 32 communicates with the outside atmosphere through a vent 42, while the chamber 34 communicates with the induction passage 16 by way of passage means such as a conduit 44, first and second parallel conduits 46 and 48 connected to the conduit 44, and passage means such as a conducit 50 connected to the conduits 46 and 48. The conduit 50 opens into the induction passage 16 at a location immediately upstream of the edge of the throttle valve 18 when the throttle valve is in its fully closed position as shown in the drawing.

A first valve 52 is disposed in the first conduit 46 and comprises a valve housing 54 into which the conduit 46 opens, a bimetallic leaf valve or valve head 56 located in the housing 54 and having an arcuate shape in cross section transverse to the axis thereof, and a valve seat 58 formed in the conduit 46 and on which the valve leaf 56 is seatable. The valve leaf 56 responds to the temperature of the engine and is deformable between a first position shown in the drawing in which it is seated on the valve seat 58 to block the conduit 46 and a second position in which it is unseated from the valve seat 58 to open the conduit 46. The first valve 52 is in contact relationship with the coolant (no numeral) of the engine or a passageway 60 which conducts the engine coolant, so that the valve leaf 56 senses the engine temperature. The valve leaf 6 is formed and constructed to have a first thermal hysteresis characteristics, as shown in FIG. 2 of the drawings and which will be described in detail later, in which the first valve leaf 56 takes alternatively the first and second positions within a first predetermined temperature range and in dependence on the engine temperature of the time of start of the engine to which the engine is cooled from a temperature higher than a temperature in the first temperature range.

A second valve 62 is disposed in the second conduit 48 and comprises a valve housing 64 into which the conduit 48 opens, a bimetallic leaf valve or valve head 66 located in the housing 64 and having an arcuate shape in cross section transverse to the axis thereof, and a valve seat 68 formed in the conduit 48 and on which the valve leaf 66 is seatable. The valve leaf 66 responds to the engine temperature and is deformable between a first position shown in the drawing in which it is seated on the valve seat 68 to block the conduit 48 and a second position in which it is unseated from the valve seat 68 to open the conduit 48. The second valve 62 is in contact relationship with the engine coolant or the passageway 60 so that the valve leaf 66 senses the engine temperature. The valve leaf 66 is formed and constructed to have a second thermal hysteresis characteristics, as shown in FIG. 2 of the drawings and which will be described in detail below, in which the second valve leaf 66 takes alternatively the first and second positions within a second predetermined temperature range and in dependence on the engine temperature of the time of start of the engine to which the engine is cooled from a temperature higher than a temperature in the second temperature range.

Referring to FIG. 2, the first and second thermal hysteresis or operation characteristics of the valve leaves 56 and 66 are shown respectively in the upper part and the lower part of the drawing. When the valve leaf 56 and accordingly the engine, for example, the engine coolant are cooled to a temperature lower than a first predetermined temperature $T_1$, the valve leaf 56 is in the second position to open the conduit 46 until the valve leaf 56 and accordingly the engine are heated to a second predetermined temperature $T_2$ higher than the temperature $T_1$, as shown by the line AB in the drawing. When the temperature $T_2$ is attained, the valve leaf 56 is moved from the second position into the first position to block the conduit 46 as shown by the line BC in the drawing. When the valve leaf 56 and according the engine are heated to a temperature higher than the temperature $T_2$, the valve leaf 56 remains in the first position until the valve leaf 56 and accordingly the engine are cooled to the temperature $T_1$, as shown by the line DCE in the drawing. When the temperature $T_1$ is attained, the valve leaf 56 is moved from the first position into the second position as shown by the line EF in the drawing.

When the valve leaf 66 and accordingly the engine, for example, the engine coolant are cooled to a temperature lower than a third predetermined temperature $T_3$, the valve leaf 66 is in the first position to block the conduit 48 until the valve leaf 66 and accordingly the engine are heated to a fourth predetermined temperature $T_4$ higher than the temperature $T_3$, as shown by the line GH in the drawing. When the temperature $T_4$ is attained, the valve leaf 66 is moved from the first position into the second position to open the conduit 48 as shown by the line HI in the drawing. When the valve leaf 66 and accordingly the engine are heated to a temperature higher than the temperature $T_4$, the valve leaf 66 remains in the second position until the valve leaf 66 and accordingly the engine are cooled to the temperature $T_3$, as shown by the line JIK in the drawing. When the temperature $T_3$ is attained, the valve leaf 66 is moved from the second position into the first position as shown by the line KL in the drawing. In this instance, the temperature $T_3$ is higher than the temperature $T_1$ and the temperature $T_4$ is lower than the temperature $T_2$. The temperature $T_1$ and $T_2$ and the temperatures $T_3$ and $T_4$ are determined respectively in dependence on the warming-up characteristics of the engine and an engine exhaust gas reburning or purifying device 69 provided in the exhaust system of the engine 11 and may be, for example, 15° C, 65° C, 45° C and 60° C, respectively, when a thermal reactor is employed as the exhaust gas purifying device.

Each of the first and second thermal hysteresis characteristics is obtained by selecting the curvatures of the arcuate shapes of the corresponding valve leaves or selecting the desirable two materials of the bimetals of the corresponding valve leaves. The larger the curvature is, the larger the obtained thermal hysteresis is or the larger the temperature range of the thermal hysteresis such as $T_1 \sim T_2$ or $T_3 \sim T_4$ is.

The ignition timing control system thus far described is operated as follows:

When the engine is started with the temperature of the engine and the valve leaves 56 and 66 lower than the temperature $T_1$, the valve leaf 56 is in the second position and the valve leaf 66 in the first position. Accordingly, the induction passage vacuum is transmitted into the vacuum chamber 34 of the vacuum motor 28 through the conduit 46 and the first valve 52 causing the actuating rod 38 to move leftward in the drawing to advance the ignition timing. As a result, the output of the engine is increased to prevent difficult engine starts or engine stops because of large resistance, due to cold engine, against movement of operating or sliding parts of the engine so that the engine is quickly warmed up. Before the engine is warmed up to normal engine operating temperature, that is, the temperature $T_2$ to complete warming-up of the engine and accordingly the valve leaf 56 is moved into the first position, the valve leaf 66 is moved into the second position to complete warming-up of the exhaust gas purifying device when the engine is warmed up to the temperature $T_4$. Accordingly, the ignition timing is continuously advanced after starting the engine. In this instance, the ignition timing of the engine is not retarded when the engine is warmed up to the temperature $T_1$, since the engine exhaust gas purifying device is warmed up before the engine is warmed up and, when the ignition timing is retarded in the course of warming-up of the engine, the sensibility of the engine is rendered dull and the warm-up of the engine is delayed.

When the engine is started with the engine and the valve leaves 56 and 66 cooled from a temperature above the temperature $T_2$ to a temperature in the temperature range, $T_1 \sim T_3$, the valve leaves 56 and 66 both are in the first position so that the induction passage vacuum is not transmitted into the vacuum chamber 34 of the vacuum motor 28. Accordingly, the spring 40 in the vacuum chamber 34 forces the actuating rod 38 to move rightward in the drawing to retard the ignition timing. As a result, warming-up of the exhaust gas purifying device is promoted to increase oxidation of the burnable harmful components in the engine exhaust gas. When the engine is warmed up to the temperature $T_4$ to complete warming-up of the exhaust gas purifying device, the valve leaf 66 is moved into the second position. Accordingly, the induction passage vacuum is transmitted into the vacuum chamber 34 of the vacuum motor 28 through the conduit 48 and the second valve 62 to advance the ignition timing. As a result, the operating performance of the engine is increased and stabilized and fuel consumption is reduced.

When the engine is started with the engine and the valve leaves 56 and 66 cooled from a temperature above the temperature $T_2$ to a temperature higher than the temperature $T_3$, the valve leaf 56 is in the first position and the valve leaf 66 in the second position. Accordingly, the induction passage vacuum is transmitted into the vacuum chamber 34 to advance the ignition timing. In this instance, since the engine and the exhaust gas purifying device have a relatively high temperature, it is unnecessary to retard the ignition timing and the ignition timing is advanced so that the engine of a motor vehicle can immediately run the vehicle. During engine operation after starting, the ignition timing is maintained advanced to improve the operating performance of the engine.

When an ignition timing control system according to the invention is applied to an engine having a carburettor with an automatic choke valve, the conduit 44 may communicate through a conduit 70 with a vacuum chamber 72 of a diaphragm unit (no numeral) for operating or rotating a first idle cam of the carburettor, as shown by the dotted lines in FIG. 1. When the engine is started and the engine coolant is heated to the predetermined temperature $T_4$ approximately completing the warming-up of the engine, the valve leaf 66 is moved into the second position so that the induction passage vacuum is transmitted into the vacuum chamber 72 of the diaphragm unit to automatically make the degree of opening of the throttle valve small. Thus, even if the motor vehicle driver leaves the vehicle during warming-up operation of the engine, the engine is quickly warmed up and excessive increases in the engine speed and in the engine exhaust gas temperature are prevented after completing warming-up of the engine.

The conduit 44 may be also connected to a purge control valve of a cansister having an absorbent for absorbing fuel vapour escaping from the fuel tank. When the valve 52 or 62 is opened to transmit the induction passage vacuum to the conduit 44, the purge control valve is operated to purge the canister from its absorbed fuel vapour.

It will be appreciated that an ignition timing control system according to the invention is provided with two bimetallic leaf valves having thermal hysteresis characteristics different from each other to permit or inhibit transmission of engine induction passage vacuum to a distributor advance motor to advance or retard the ignition timing in accordance with engine temperature of the time of start of the engine and within a predetermined temperature range after starting the engine so that the engine and/or an exhaust gas purifying device thereof is quickly warmed up.

What is claimed is:

1. An ignition timing control system for an internal combustion engine including an induction passageway having a throttle valve rotatably mounted therein, said system comprising a vacuum motor adapted for controlling the ignition timing of said engine, first and second passage means adpated for providing communication between said vacuum motor and said induction passageway immediately upstream of the edge of said throttle valve in its fully closed position for applying vacuum in said induction passageway to said vacuum motor to operate it, said first passage means being located in parallel with said second passage means, and first and second bimetallic leaf valve means disposed respectively in said first and second passage means for closing and opening the corresponding passage means in accordance with the temperature of said engine to control vacuum application to said vacuum motor, said first leaf valve means being formed and constructed to have a thermal hysteresis characteristics in which said first leaf valve means, when in a first predetermined temperature range, alternatively closes and opens said first passage means in dependence on a temperature to which said first leaf valve means is cooled from a temperature higher than a temperature in said first predetermined temperature range, said second leaf valve means being formed and constructed to have a thermal hysteresis characteristics which is different from said thermal hyteresis charactertistics of said first leaf valve means and in which said second leaf valve means when in a second predetermined temperature range different from said first predetermined temperature range, alternatively closes and opens said second passage means in dependence on a temperature to which said second leaf valve means is cooled from a temperature higher than a temperature in said second predetermined temperature range.

2. An ignition timing control system for an internal combustion engine including an induction passageway having a throttle valve rotatably mounted therein, said system comprising an ignition distributor having a breaker plate, a vacuum motor having a flexible diaphragm operatively connected to said breaker plate and adapted to control the ignition timing of said engine and a vacuum chamber formed on a side of said diaphragm, parallel first and second passage means adapted for providing communication between said vacuum chamber and said induction passageway immediately upstream of the edge of said throttle valve in its fully closed position for supply of vacuum in said intake passageway into said vacuum chamber, and first and second bimetallic leaf valve means disposed respectively in said first and second passage means for closing and opening the corresponding passage means in accordance with the temperature of said engine to control vacuum supply into said vacuum chamber, said first leaf valve means being formed and constructed to have a first thermal hysteresis characteristics in which said first leaf valve means, when in a first predetermined temperature range, alternatively closes and opens said first passage means in dependence on a temperature to which said first leaf valve means is cooled from a temperature higher than a temperature in said first predetermined temperature range, said second leaf valve means being formed and constructed to have a second thermal hysteresis characteristics which is different from said first thermal hysteresis characteristics and in which said second leaf valve means, when in a second predetermined temperature range different from said first predetermined temperature range, alternatively closes and opens said second passage means in dependence on a temperature to which said second leaf valve means is cooled from a temperature higher than a temperature in said second predetermined temperature range.

3. An ignition timing control system according to claim 2, in which said first thermal hysteresis characteristics of said first leaf valve means is such that when said first leaf valve means is cooled to a temperature lower than a first predetermined temperature, it opens said first passage means until it is heated to a second predetermined temperature higher than said first predetermined temperature, and when it is heated to a temperature higher than said second predetermined temperature, it closes said first passage means until it is cooled to said first predetermined temperature, and said second thermal hysteresis characteristics of said second leaf valve means is such that when said second leaf valve means is cooled to a temperature lower than a third predetermined temperature, it closes said second passage means until it is heated to a fourth predetermined temperature higher than said third predetermined temperature, and when said second leaf valve means is heated to a temperature higher than said fourth predetermined temperature, it opens said second passage means until it is cooled to said third predetermined temperature, said third predetermined temperature being higher than said first predetermined temperature, said fourth predetermined temperature being lower than said second predetermined temperature.

4. An ignition timing control system according to claim 3, in which said second predetermined temperature is a temperature at which warming-up of said engine is completed and said fourth predetermined temperature is a temperature at which warming-up of an exhaust gas purifying device for said engine is completed.

5. An ignition timing control system in combination with an internal combustion engine including an induction passageway having a throttle valve rotatably mounted therein, and an ignition distributor having a breaker plate, said system comprising a vacuum motor having a flexible diaphragm operatively connected to said breaker plate to control the ignition timing of said engine and a vacuum chamber formed on a side of said diaphragm, first and second passage means for providing communication between said vacuum chamber and said induction passageway immediately upstream of the edge of said throttle valve in its fully closed position for supply of vacuum in said intake passageway into said vacuum chamber, said first passage means being located in parallel with said second passage means, and first and second bimetallic leaf valve means disposed respectively in said first and second passage means for closing and opening the corresponding passage means in accordance with the temperature of said engine to control vacuum supply into said vacuum chamber, said first leaf valve means being formed and constructed to have a first thermal hysteresis characteristics in which said first leaf valve means, when in a first predetermined temperature range, alternatively closes and opens said first passage means in dependence on a temperature to which said first leaf valve means is cooled from a temperature higher than a temperature in said first predetermined temperature range, said second leaf valve means being formed and constructed to have a second thermal hysteresis characterstics which is different from said first thermal hysteresis characteristics and in which said second leaf valve means, when in a second predetermined temperature range different from said first predetermined temperature range, alternatively closes and opens said second passage means in dependence on a temperature to which said second leaf valve means is cooled from a temperature higher than a temperature in said second predetermined temperature range.

6. An ignition timing control system according to claim 5, in which said first thermal hysteresis characteristics of said first leaf valve means is such that when said first leaf valve means is cooled to a temperature lower than a first predetermined temperature, it opens said first passage means until it is heated to a second predetermined temperature higher than said first predetermined temperature, and when it is heated to a temperature higher than said second predetermined temperature, it closes said first passage means until it is cooled to said first predetermined temperature, and said second thermal hysteresis characteristics of said second leaf valve means is such that when said second leaf valve means is cooled to a temperature lower than a third predetermined temperature, it closes said second passage means until it is heated to a fourth predetermined temperature higher than said third predetermined temperature, and when said second leaf valve means is heated to a temperature higher than said fourth predetermined temperature, it opens said second passage means until it is cooled to said third predetermined temperature, said third predetermined temperature being higher than said first predetermined temperature, said fourth predetermined temperature being lower than said second predetermined temperature.

7. An ignition timing control system according to claim 6, in which said engine further includes an exhaust gas purifying device, and in which said second predetermined temperature is a temperature at which warming-up of said engine is completed and said fourth predetermined temperature is a temperature at which warming-up of said exhaust gas purifying device is completed.

* * * * *